US010464224B2

(12) United States Patent
Dechant et al.

(10) Patent No.: US 10,464,224 B2
(45) Date of Patent: Nov. 5, 2019

(54) UTILITY KNIFE BLADE RETENTION MECHANISM

(71) Applicant: Fiskars Finland Oy Ab, Helsinki (FI)

(72) Inventors: Stephen P. Dechant, Waunakee, WI (US); Steven Stokes, Fitchburg, WI (US)

(73) Assignee: Fiskars Finland Oy Ab, Helsinki (FI)

( * ) Notice: Subject to any disclaimer, the term of this patent is extended or adjusted under 35 U.S.C. 154(b) by 151 days.

(21) Appl. No.: 15/649,325

(22) Filed: Jul. 13, 2017

(65) Prior Publication Data

US 2019/0015996 A1 Jan. 17, 2019

(51) Int. Cl.
*B26B 5/00* (2006.01)

(52) U.S. Cl.
CPC ..... *B26B 5/006* (2013.01); *B26B 5/00* (2013.01)

(58) Field of Classification Search
CPC .. B26B 1/08; B26B 5/00; B26B 5/001; B26B 5/006
USPC ..... 30/153, 155–162
See application file for complete search history.

(56) References Cited

U.S. PATENT DOCUMENTS 5,495,670 A * 3/1996 Quinn ..... B26B 5/001 30/162
5,603,162 A * 2/1997 Chen ..... B26B 5/001 30/162
6,192,589 B1 * 2/2001 Martone ..... B26B 5/001 30/162
6,249,975 B1 * 6/2001 Lin ..... B26B 5/001 30/162
6,446,340 B1 * 9/2002 Ping ..... B26B 5/001 30/162
6,742,261 B2 * 6/2004 Ho ..... B26B 5/001 30/162
6,829,827 B2 * 12/2004 Tseng ..... B26B 5/001 30/162
7,107,688 B1 9/2006 Critelli et al.
7,305,770 B2 * 12/2007 Critelli ..... B26B 5/001 30/162
7,552,537 B2 * 6/2009 Ye ..... B26B 1/042 30/155
7,814,664 B2 * 10/2010 LeBlanc ..... B26B 5/00 30/156
8,001,641 B1 * 8/2011 Williams ..... B26B 29/02 30/162
8,220,161 B2 * 7/2012 Chang ..... B26B 29/02 30/162

(Continued)

FOREIGN PATENT DOCUMENTS

DE 20 2008 001 658 7/2008

OTHER PUBLICATIONS

International Search Report and Written Opinion for International Application No. PCT/US2018/041211, dated Oct. 12, 2018, 12 pages.

*Primary Examiner* — Jason Daniel Prone
(74) *Attorney, Agent, or Firm* — Foley & Lardner LLP

(57) ABSTRACT

A utility knife includes a blade carrier configured to releasably couple to a blade; and a blade retention mechanism coupled to the blade carrier. The blade retention mechanism includes a first actuator; and a second actuator coupled to the first actuator, wherein an actuation of the first actuator permits the second actuator to move from a locked position to an unlocked position for the blade.

4 Claims, 8 Drawing Sheets

(56) References Cited

U.S. PATENT DOCUMENTS

| | | | | |
|---|---|---|---|---|
| 8,567,069 | B2 * | 10/2013 | Robinson | B26B 5/00 30/155 |
| 10,144,139 | B2 * | 12/2018 | Squiers | B26B 5/003 |
| D840,774 | S * | 2/2019 | Dechant | D8/14 |
| 2002/0029480 | A1 * | 3/2002 | Lin | B26B 5/001 30/125 |
| 2003/0037444 | A1 * | 2/2003 | Chunn | B26B 5/00 30/337 |
| 2004/0163261 | A1 * | 8/2004 | Lin | B26B 5/001 30/162 |
| 2005/0274024 | A1 * | 12/2005 | Jinliang | B26B 1/042 30/153 |
| 2005/0278955 | A1 | 12/2005 | Lee | |
| 2007/0157472 | A1 * | 7/2007 | Critelli | B26B 1/04 30/162 |
| 2007/0169353 | A1 | 7/2007 | Wu | |
| 2008/0250650 | A1 * | 10/2008 | Seber | B26B 5/001 30/162 |
| 2009/0165309 | A1 | 7/2009 | Kamb et al. | |
| 2009/0235535 | A1 * | 9/2009 | Circosta | A47L 13/08 30/162 |
| 2010/0018060 | A1 * | 1/2010 | Lin | B26B 1/02 30/151 |
| 2010/0107424 | A1 | 5/2010 | Garcia et al. | |
| 2011/0041344 | A1 * | 2/2011 | De | B26B 5/001 30/162 |
| 2011/0283542 | A1 * | 11/2011 | Wu | B26B 5/003 30/162 |
| 2015/0258696 | A1 * | 9/2015 | Wang | B26B 5/00 30/162 |
| 2016/0346941 | A1 * | 12/2016 | Chen | B26B 1/08 |
| 2018/0029240 | A1 * | 2/2018 | Douglass | B26B 5/003 |

* cited by examiner

UTILITY KNIFE BLADE RETENTION MECHANISM

FIELD

The present disclosure relates to hand operated tools. More particularly, the present disclosure relates to a blade retention mechanism for a utility knife.

BACKGROUND

This section is intended to provide a background or context to the disclosure recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Hand operated tools can take a variety of forms including hand operated striking tools (e.g., a hammer) to hand operated cutting tools (e.g., a scissors). Within the general category of hand operated cutting tools, one-hand operated and two-hand operated cutting tools exist. Examples of one-hand operated cutting tools include scissors, shears, pruners, utility knives, and snips. An example of a two-hand operated cutting tool includes a lopper.

Utility knives are aptly named due to their wide array of uses from carpentry to everyday uses (e.g., cutting string for a home project or a hobby). A utility knife typically includes a handle, a blade holder coupled to the handle, and a knife or blade retained by the blade holder. Often, the blade is releasably coupled to the blade holder by a "quick-change" push-button or a swing lever, which when actuated enables the release of the blade from the blade holder. While advantageous for quickly replacing the blade in the utility knife, these quick-change mechanisms can sacrifice security due to accidental pressure or inadvertent bumps to the release mechanism loosening the retention of the blade in the blade holder or altogether discharging the blade from the blade holder. Thus, the ability to use the utility knife may be compromised due to these quick-change mechanisms.

SUMMARY

One embodiment relates to a utility knife. The utility knife includes a handle; a blade carrier coupled to the handle, the blade carrier configured to releasably couple to a utility knife blade; and a blade retention mechanism coupled to the blade carrier. The blade retention mechanism includes a button; and a slider coupled to the button, the slider movable between a locked position and an unlocked position, wherein in the locked position the slider engages with the utility knife blade to securably retain the utility knife blade, wherein in the unlocked position the slider is disengaged from the utility knife blade to permit removal of the utility knife blade, and wherein during a movement of the slider from the locked position to the unlocked position, the slider moves away from the blade carrier. According to one embodiment, an actuation of the button enables the slider to move from the locked position to the unlocked position.

Another embodiment relates to a blade retention mechanism for a utility knife blade for a utility knife. The blade retention mechanism includes a slider having a body, the body defining a cavity; a biasing member at least partly disposed in the cavity; and an actuator coupled to the biasing member, wherein upon actuation of the actuator, the actuator and slider are movable from a locked position to an unlocked position, wherein in the locked position the slider engages with the utility knife blade to securably retain the utility knife blade, wherein in the unlocked position the slider is disengaged from the utility knife blade to permit removal of the utility knife blade. According to one configuration, during a movement of the actuator and slider to the unlocked position, the actuator is at least partly received in the cavity.

Still another embodiment relates to a utility knife. The utility knife includes a blade carrier configured to releasably couple to a blade; and a blade retention mechanism coupled to the blade carrier. The blade retention mechanism includes a first actuator; and a second actuator, wherein an actuation of the first actuator permits the second actuator to move from a locked position to an unlocked position for the blade.

DETAILED DESCRIPTION

Referring to the Figures generally, a blade retention mechanism for a utility knife is shown and described herein according to various embodiments. As described more fully herein, a utility knife includes a blade retention or locking system. The blade retention system includes a first actuator, shown as a button herein, coupled to a second actuator, shown as a slider herein. The slider includes a projection configured to engage with a recess of a conventional utility knife blade. In operation, a user actuates the button to enable the slider to move vertically upwards and away from a blade carrier of the utility knife. Movement of the slider vertically upwards disengages the projection from the recess to enable the utility knife blade to be removed and replaced. When the utility knife blade is positioned back within the blade carrier and the user desires to lock the utility knife blade in the utility knife for use, the user simply pushes the slider vertically downwards to engage the projection with the recess. A biasing mechanism (e.g., a spring) then pushes the button outward and away from the slider to engage with the blade carrier. Due to the coupling of the button to the slider and the engagement of the biasing mechanism with the blade carrier, the slider is then also in a locked position (i.e., unable to be moved vertically upwards). When the slider is locked, the utility knife blade is locked in place for a user to use the utility knife.

Beneficially, the blade retention mechanism of the present disclosure provides several advantages over conventional blade retention mechanisms. For example, the use of the button in combination with moving the slider represents a two-prong unlocking system, which is in contrast to conventional one-prong unlocking systems. The two-prong unlocking system is advantageous in that the completion of both prongs is more involved than conventional one-prong unlocking systems, which may prevent accidental or inadvertent unlocking of the utility knife blade relative to conventional systems. That said, Applicant has determined that accomplishing the two-prongs is still a relatively quick endeavor, such that the ability of a user to quickly replace blades is not compromised. As another example, because the slider extends upward and away from the blade carrier (and the rest of the utility knife), a visual indication is provide to the user whether the blade retention mechanism is in the locked or unlocked positions. Existing locking mechanisms are typically visually ambiguous in that no clues regarding whether the blade is securely locked or unlocked are provided. This is problematic and dangerous because users may pull on the blade to check whether the blade is secure or not. These and other features and advantages are described more fully herein.

Figure 11:
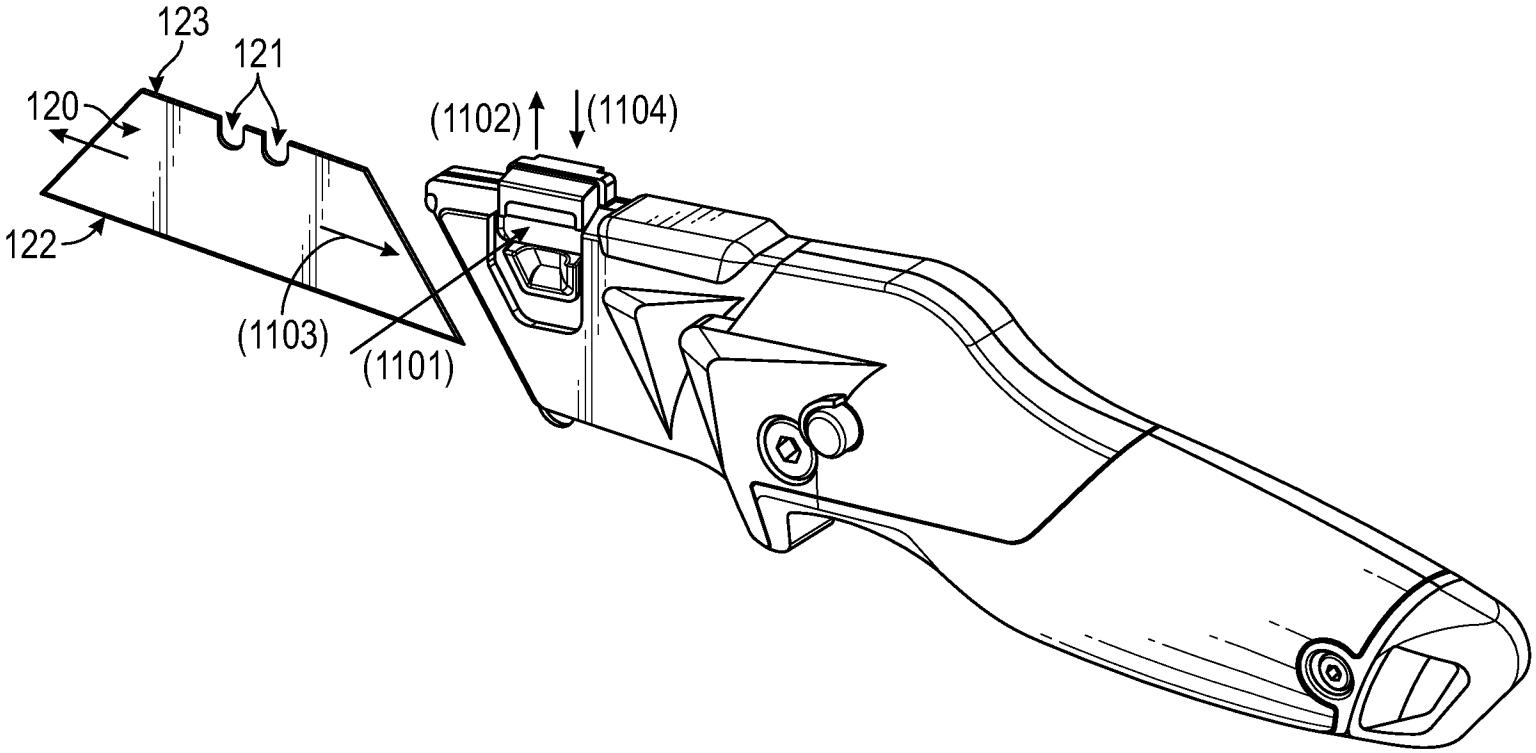
FIG. 11 is a graphical depiction of a process of inserting and securing a blade in a utility knife using the blade retention mechanism of FIGS. 1-10B, according to an exemplary embodiment.

As used herein, the term "vertical" or variations thereof (e.g., vertically) refers to a direction that is perpendicular or substantially perpendicular to a longitudinal axis of the utility knife (i.e., from the utility knife blade to the handle is representative of the longitudinal axis). With reference briefly to FIG. 11, upwards vertical movement is shown with the arrow in step 1102 while downwards vertical movement is shown by the arrow with step 1104. In contrast, the arrows of step 1103 show movement along the longitudinal axis of the utility knife. That said, the present disclosure contemplates that the term "vertical" can be broadly interpreted to encompass a variety of movements associated with the arrows in steps 1102 and 1104 of FIG. 11 that are not necessarily perpendicular to the longitudinal axis of the utility knife (i.e., the movements may be angularly related to the longitudinal axis). Thus and while the present disclosure primarily describes and shows the vertical movements as perpendicular to the longitudinal axis, this description and depiction is not meant to be limiting.

Referring now to FIGS. 1-8, various views of a utility knife with a blade retention mechanism are shown, accordingly to an exemplary embodiment. The utility knife 100 (e.g., box cutter, razor blade knife, razor knife, etc.) may be used for a variety of purposes including, but not limited to, cutting for crafts, cutting drywall, cutting various paper objects (e.g., cardboard, etc.), cutting animals (e.g., cleaning fish, etc.), scoring objects, gardening (e.g., cutting or trimming plants, etc.) and a host of other purposes. Those of ordinary skill in the art will readily recognize and appreciate the wide range of uses for the utility knife 100 of the present disclosure.

The utility knife 100 is shown to include handle 110, a blade carrier 130 coupled to the handle 110, a replaceable utility knife blade 120 (e.g., blade, etc.) releasably coupled to the blade carrier 130, and a blade retention mechanism 150 configured to selectively lock and unlock the blade 120 to the utility knife 100.

Figure 9:
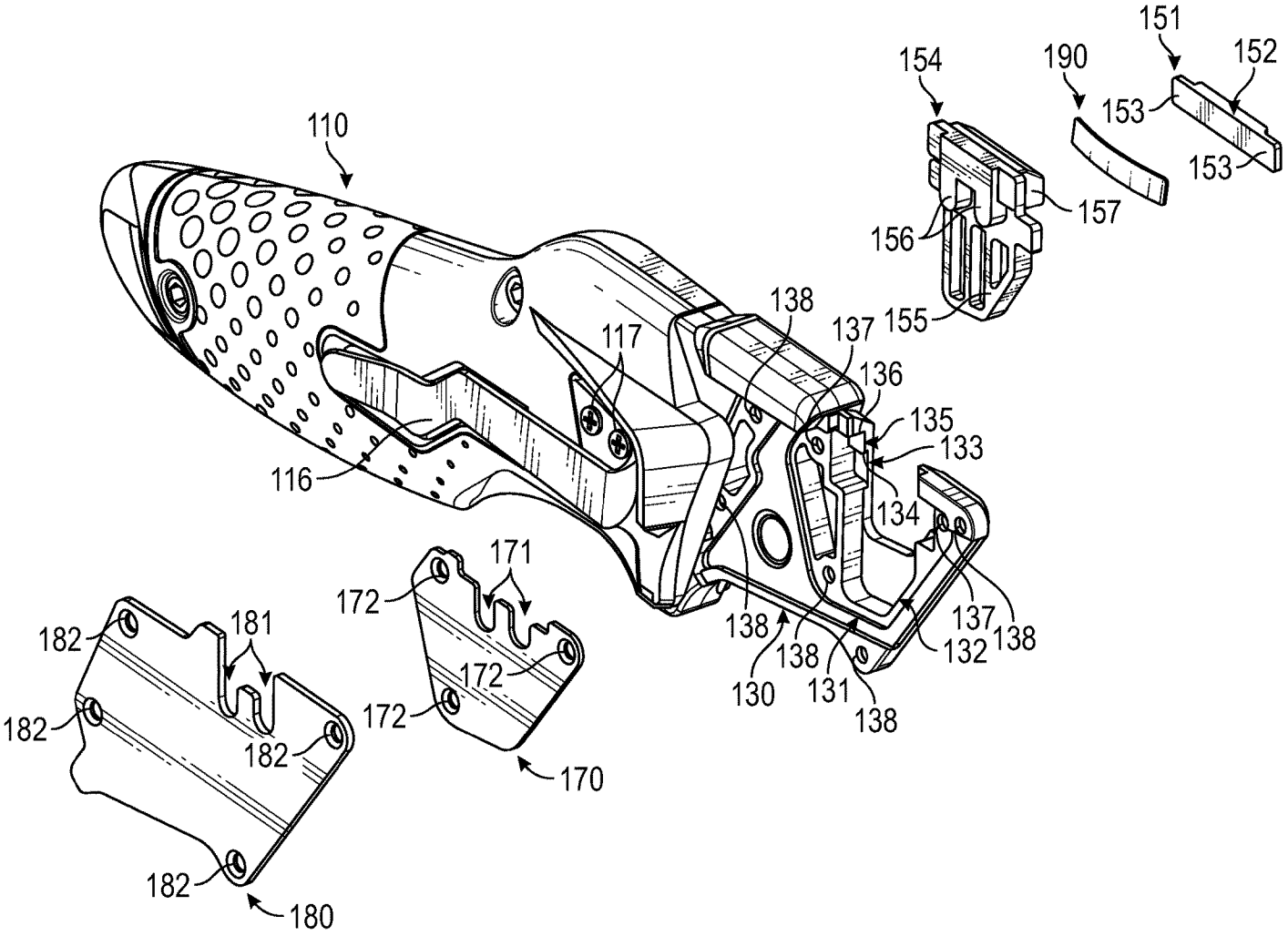
FIG. 9 is an exploded assembly view of the utility knife of FIG. 1, according to an exemplary embodiment.

The handle 110 generally defines a user engagement portion for the utility knife 100. In this regard, a user may grab, hold, or otherwise engage primarily with the handle 110 when using the utility knife 100. The handle 100 includes a grip part 111 and a finger recess 112. With reference to FIG. 9, the handle 100 also includes a clip 116 coupled to the handle 100 via a pair of fasteners 117 (e.g., screws, rivets, adhesive, etc.). As shown, the grip part 111 is disposed generally circumferentially about the handle 110, while the finger recess 112 is positioned on the bottom of the handle 110. Of course, in other embodiments, the grip part 111 may be disposed in a different area or all of the area of the handle 110 while the finger recess 112 may have a different location, a different shape, or be removed entirely from the handle 110. In one embodiment, the grip part 111 and finger recess 112 are constructed from a rubber-based material in order to provide an ergonomic and comfortability benefit to the user of the utility knife 100. In other embodiments, a variety of other types of materials may be used to construct these features. The clip 116 is structured to slide over a desired object (e.g., a tool belt) in order to hold or retain the knife 100 to the desired object. The clip 116 may have a variety of shapes of sizes, such that the depicted shape and size is not meant to be limiting. Additionally, the position of the clip 116 on only one side of the handle 110 is also not meant to be limiting as the clip 116 may be positioned on both sides of the handle 110, on a different side of the handle 110, in a different location on the handle 110, and various other alternatives. Further, in some embodiments, the clip 116 may be excluded from the utility knife 100.

In the example shown, the handle 110 is predominately constructed from two halves that couple to each other to define a longitudinal slot or opening 118. Coupling of the two halves may be via one or more fasteners or joining methods (e.g., adhesive, welding, etc.). In the example depicted, a fastener 113 (e.g., screw, pin, etc.) as well as the pivot mechanism 114 (e.g., pin, etc.) and button 115 facilitate coupling the two halves of the handle 110 together. In this regard, the button 115 and pivot mechanism 114 extend between the two halves to aid coupling of the halves together.

Figure 1:
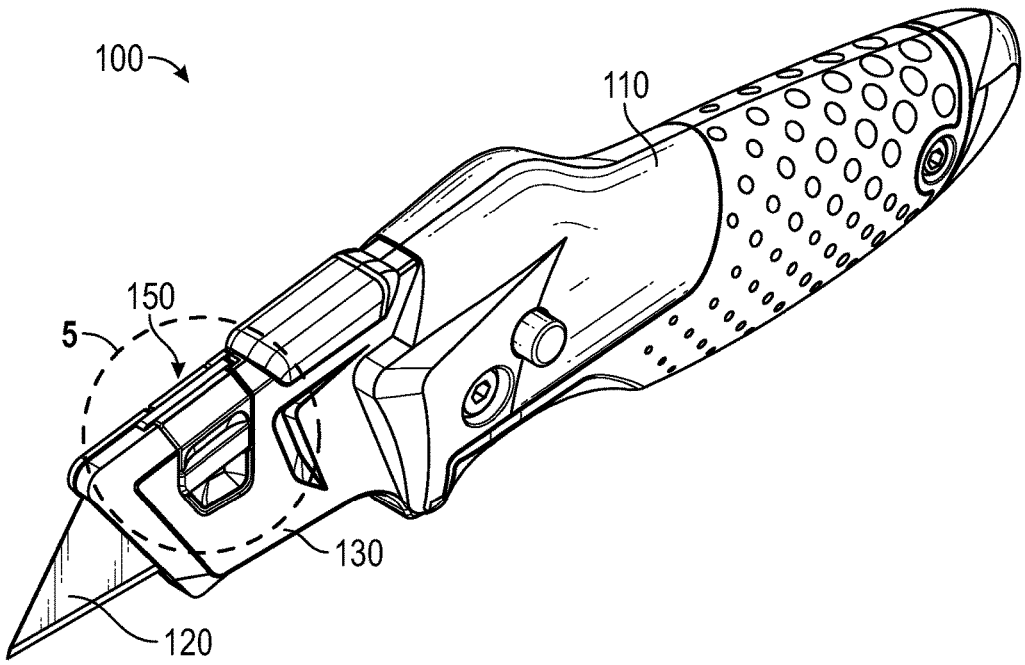
FIG. 1 is a front perspective view of a utility knife with a blade retention mechanism, according to an exemplary embodiment.
Figure 2:
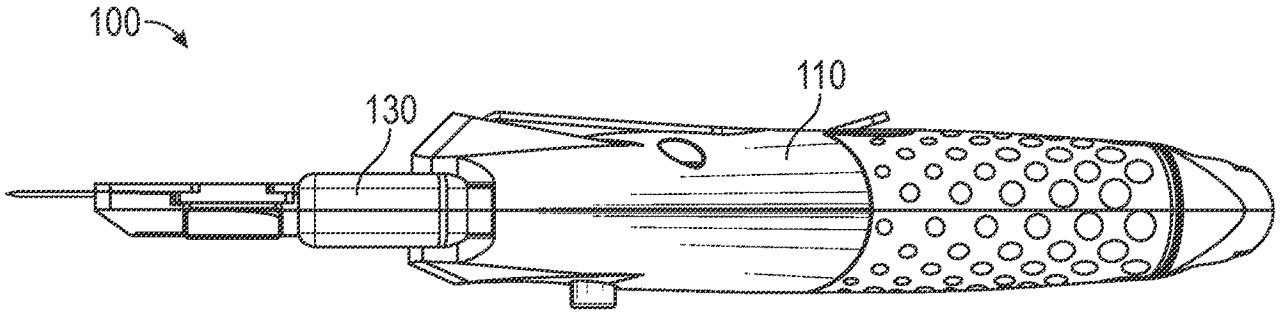
FIG. 2 is a top view of the utility knife of FIG. 1, according to an exemplary embodiment.
Figure 3:
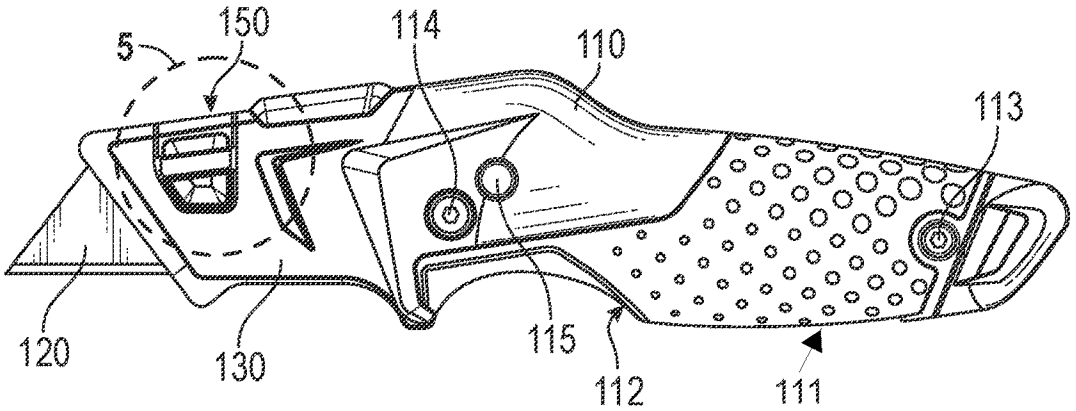
FIG. 3 is a right side view of the utility knife of FIG. 1, according to an exemplary embodiment.
Figure 4A:
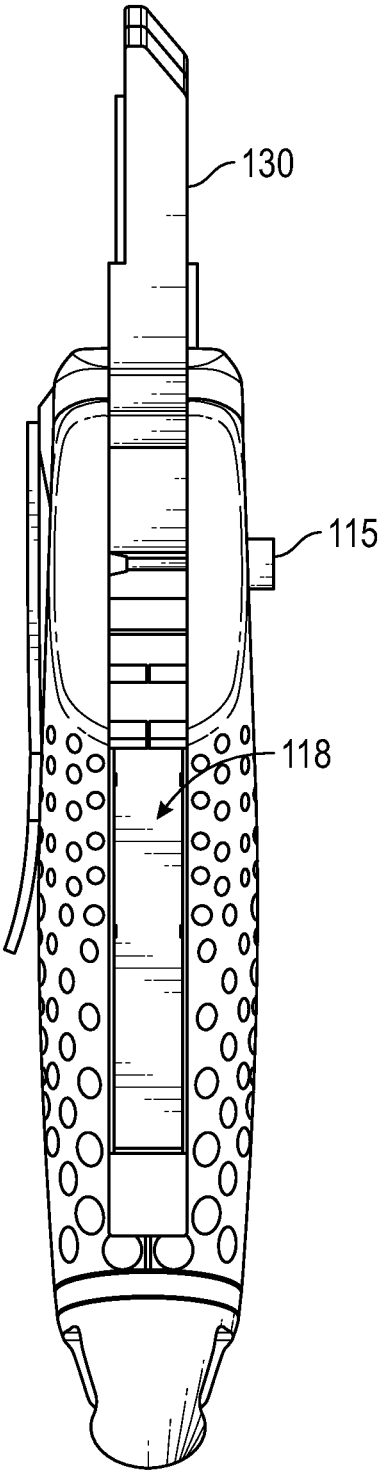
FIGS. 4A-4B are bottom views of the utility knife of FIG. 1 with the blade carrier in an extended position from the handle (FIG. 4A) and in a folded position (FIG. 4B), according to exemplary embodiments.
Figure 4B:
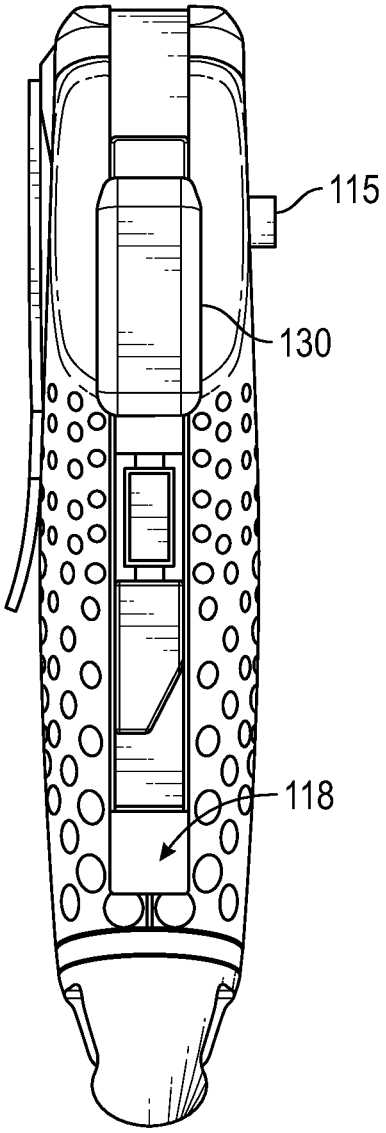

The pivot mechanism 114 couples the blade carrier 130 and blade 120 to the handle 110. The button 115 is structured to selectively engage with the pin or pivot mechanism 114 to prevent or permit rotation of the blade carrier 130 and blade 120 about the pin 114. For example, in one embodiment, the button 115 includes a projection disposed within the longitudinal slot 118 between the two halves while the pin 114 also includes a projection disposed within the longitudinal slot 118. When the button 115 is depressed, the projections disengage thereby allowing the blade carrier 130 and blade 120 to rotate about the pivot mechanism 114. When the button 115 is not depressed, the projections engage with each other to prevent relative rotation. Of course, in other embodiments, any other type rotation mechanism may be employed with utility knife 100. In operation, a user can push the button 115 (with reference to FIG. 3, move the button into the page), which causes the button 115 to disengage or otherwise releases the button 115 from holding the pin 114. This release enables the blade carrier 130 and blade (if in the blade carrier 130) to rotate between a stowed position (FIG. 4B) and a use position (FIG. 4A). In the stowed position, the blade carrier 130 and blade 120 are positioned in or substantially received in the slot 118 defined by the two halves of the handle 110. In the use position, the blade carrier 130 and blade 120 are extended outward and away from the handle 110. The use position is depicted in FIGS. 1-3. The stowed position is depicted in FIG. 4B.

According to an alternate embodiment, the blade carrier 130 may not be rotatable or movable relative to the handle 120. In this embodiment, the blade carrier 130 may be positioned permanently in the use position. In these embodiments, the structure of the handle 110 may differ from that depicted in the Figures, such as to exclude the slot 118. As a result, in this embodiment, the handle 110 may not be constructed from two halves but via some other construction methodology (e.g., as a unitary body).

Referring now to FIG. 9, in combination with FIGS. 1-8, details of the blade retention mechanism 150 and the blade carrier 130 are shown according to exemplary embodiments.

Referring first to the blade carrier 130, the blade carrier 130 (e.g., blade housing, blade carriage, etc.) is configured to couple to the utility knife blade 120 to facilitate holding and retention of the utility knife blade 120 in the locked position. As shown, the blade carrier 130 is coupled to each of the handle 110 and blade retention mechanism 150. Thus, the blade carrier 130 is an intermediary between the handle 110 and the blade retention mechanism 150. While the blade carrier 130 may be constructed from a variety of materials and via a variety of different ways (e.g., one-piece component, two or more pieces coupled together, etc.), in the example depicted, the blade carrier 130 is constructed from a metal-based material. As shown, the blade carrier 130 defines a first cavity 131 (e.g., recess, void, opening, etc.), a second cavity 132 (e.g., recess, void, opening, etc.) positioned within the first cavity 131, a first opening 133 having upper ledges 134 (e.g., lower walls, lower ledges, lower or first stops, etc.), a second opening 135 having upper ledges 136 (e.g., upper walls, upper ledges, upper or second stops, etc.), a plurality of inner holes 137 (e.g., openings), and a plurality of outer holes 138 (e.g., openings).

The first cavity 131 is structured to engage with the first plate 170 (e.g., inner plate, etc.). In this regard, the first cavity 131 is sized and shaped to at least partly receive the first plate 170. In the embodiment depicted, the first cavity 131 receives the first plate 170, such that the first plate 170 sits flush or substantially flush with the outer surface of the blade carrier 130 that defines the first cavity 131. As also shown, the plurality of inner holes 137 are defined by the blade carrier 130 and disposed within the first cavity 131. The plurality of inner holes 137, which in this embodiment are shown as three (3) holes, are each structured to receive a fastener (e.g., a screw) to couple the first plate 170 to the blade carrier 130. Of course, in other embodiments, various other adhesion or joining processes (e.g., welding, glue, etc.) may be used to couple the first plate 170 to the blade carrier 130. As described herein, coupling of the first plate 170 to the blade carrier 130 functions to constrain, secure, or otherwise at least partly hold the slider 154 of the blade retention mechanism 150.

The second cavity 132 is structured to receive or at least partly receive the slider 154 of the blade retention mechanism 150. In this regard and as shown, the second cavity 132 has a shape that matches or substantially matches the shape of the slider 154. In other embodiments, the size and shape of the second cavity 132 may differ from that depicted in the Figures. In operation, the first plate 170 is received in the first cavity 131 when coupled to the blade carrier 130. Coupling of the first plate 170 to the blade carrier 130 then provides a wall or a barrier on a back side of the second cavity 132, such that the button 151 (and parts of the blade carrier 130) and the first plate 170 sandwich in the slider 154.

As mentioned above, the blade carrier 130 includes a plurality of outer holes 138. In this example, there are four (4) holes 138. Each of the holes 138 is structured to receive a fastener (e.g., a screw, etc.) to couple the outer plate 180 to the blade carrier 130. In other embodiments, a variety of other joining mechanisms may be used to couple the blade carrier 130 to the outer plate 170 (e.g., an adhesive, a joining process such as welding, etc.). As described herein, the gap defined between the inner and outer plates 170 and 180 is structured to receive the utility knife blade 120.

The first opening 133 represents a receptacle for the button 151 when the button 151 is in the locked position. A pair of ledges 134 (e.g., lower wall, lower ledge, lower or first stop, first part of the blade carrier 130, etc.) form an upper or vertical barrier for the first opening 133 and a barrier for upward vertical movement for the button 151 (note that only one of the ledges 134 is shown in FIG. 9). The second opening 135 represents a receptacle for the button 151 and spring 190, when the button 151, spring 190, and slider 154 are in the unlocked position. A pair of ledges 136 (e.g., second part of the blade carrier 130, upper wall, upper ledge, upper or second stop) form an upper or vertical barrier for the second opening 135 and a barrier for upward vertical movement for the slider 154 and button 151 when they are in the unlocked position. In other words, engagement of the button 151 with the upper ledges 136 constrains the maximum amount of vertical movement of the slider 154 relative to the blade carrier 130.

Thus, as shown, a step system is provided between the first opening 133 and first ledges 134 with the second opening 135 and second ledges 136. In this regard, the first opening 133 protrudes or extends closer to an external surface of the blade carrier 130 proximate to the button 151 than the second opening 135. However, the second ledges 136 are positioned vertically above the first ledges 134. Placement of the button 151 in the first opening 133 represents the locked position or configuration while a placement of the button 151 in the second opening 135 represents the unlocked position or configuration.

Before turning to the blade retention mechanism 150, the first and second plates 170 and 180 are firstly described. In the example depicted, the first and second plates 170 and 180 are separate components (i.e., individual pieces). In other embodiments, the first and second plates 170 and 180 may be joined to each other and then collectively coupled to the blade carrier 130. In the example shown, the first and second plates 170 and 180 are constructed from a metal-based material. However, in other embodiments, a variety of other types of materials may be used to construct the first and second plates 170 and 180.

The first plate 170 is structured to hold, retain, or otherwise constrain the movement of the slider 154 of the blade retention mechanism 150 to only or substantially only a vertically upward and downward movement. In this regard, the blade carrier 130 and the first plate 170 surround or substantially surround the slider 154. As shown, the first plate 170 has a trapezoidal-type shape, which corresponds with the trapezoidal-type shape of the first cavity 131. In other embodiments, a variety of other shapes may be implemented with one or both of the first cavity 131 and the first plate 170.

As shown, the first plate 170 defines a pair of recesses 171 (e.g., openings, voids, gaps, etc.) and a plurality of holes 172. In this example, the first plate 170 defines three (3)

holes 172. The holes 172 correspond with the holes 137 of the blade carrier 130 to enable a fastener to be received in each of the corresponding set of holes 172 and 137. These fasteners then couple the first plate 170 to the blade carrier 130. As mentioned above, the first plate 170 also defines a pair of recesses 171. The recesses 171 are disposed at or near the vertical top of the first plate 170 (i.e., opposite side to the finger recess 112 and proximate the blade retention mechanism 150). As described herein, the recesses 171 are sized and shape to enable the projections 156 of the slider 154 to pass there-through and, eventually, engage with corresponding recesses of the utility knife blade 120.

The second plate 180 is structured to hold, support (at least partly), or otherwise help retain the utility knife blade 120 to the utility knife 100. In this regard and as mentioned above, the second plate 180 is coupled to the blade carrier 130 on the outside of the first plate 170. As such, a gap or opening is created between the plates 170 and 180 when each is coupled to the blade carrier 130. This gap or opening is structured to receive the utility knife blade 120. Thus, in use, the utility knife blade 120 is sandwiched between the first and second plates 170 and 180. This sandwiching in combination with a lower surface of the blade carrier 130 functions to hold or otherwise couple the utility knife blade 120 to the utility knife 100 and blade carrier 130.

As shown, the second plate 180 defines a pair of recesses 181 (e.g., openings, voids, gaps, etc.) and a plurality of holes 182. In this example, the second plate 180 defines four (4) holes 182. The holes 182 correspond with the holes 138 of the blade carrier 130 to enable a fastener to be received in each of the corresponding sets of holes 182 and 138. These fasteners then couple the second plate 180 to the blade carrier 130. As mentioned above, the second plate 180 also defines a pair of recesses 181. The recesses 181 are disposed at or near the vertical top of the second plate 180 (i.e., opposite side to the finger recess 112 and proximate the blade retention mechanism 150). As described herein, the recesses 181 are sized and shape to enable the projections 156 of the slider 154 to be at least partly received by the recesses 181.

Referring now briefly to FIG. 11, a structure of the utility knife blade 120 is shown according to an exemplary embodiment. As shown, the utility knife blade 120 (e.g., blade, razor, etc.) has a conventional shape and structure. In this regard and as shown, the blade 120 defines a pair of recesses 121 disposed at or near the top edge 123 of the blade 120 and a razor edge 122. The razor edge 122 may have a variety of structures (e.g., smooth razor, serrated, etc.). That said, the razor edge 122 is structured to permit and enable a cutting of a desired object. In the locked position, the recesses 121 engage with the blade retention mechanism 150 to hold or lock the blade 120 to the mechanism 150 and blade carrier 130. In operation and outside of the blade carrier 130, the blade 120 may be rotated about a vertical axis (i.e., an axis that stretches from the top edge 123 to the razor edge 122) to control which part of the razor edge extends out of the blade carrier 130 when in use. In this regard, a user may rotate the blade 120 to control which part of the razor edge 122 is useable thereby extending the useable life of the blade 120.

With the above description in mind and still referring to FIGS. 1-9 with a particular emphasis on FIG. 9, explanation of the blade retention mechanism 150 may be described as follows. The blade retention mechanism 150 (e.g., blade retention assembly, blade retention system, blade locking system or assembly, locking system, and the like) is coupled to the blade carrier 130, and structured to selectively lock the blade 120 to the knife 100 and unlock the blade 120 from the knife 100 to permit, e.g., a replacement of the blade. As described herein, the blade retention mechanism 150 utilizes two features or prongs that are required to be actuated before the blade retention mechanism 150 enables the release of the blade 120. As shown, the blade retention mechanism 150 generally includes a button 151, a slider 154, and a spring 190 that interfaces with each of the button 151 and the slider 154.

The button 151 (e.g., push button, first actuator) includes a user interface portion 152 interconnected with a pair of tabs 153. In the example shown, the button 151, user interface portion 152, and tabs 153 are of integral construction (i.e., a one-piece component). In other embodiments, one or more of the aforementioned components may be an independent component, which is coupled to the remaining components to form the button 151. The user interface portion 152 is an area of the button 151 that the user pushes or otherwise applies a force to when the user actuates the button 151. As shown, the user interface portion 152 extends outward and away from the button 151 (i.e., away from the slider 154). Thus, this front area of the button 151 with the user interface portion 152 represents a non-coplanar surface. In contrast, a back surface of the button 151 proximate to the spring 190 when the mechanism 150 is assembled is a substantially flat or planar surface. In the example depicted, the button 151 is constructed from a metal-based material. In other embodiments, a variety of other materials may be used to construct the button 151.

When assembled, the button 151 is received in the first opening 133 of the blade carrier 130. The tabs 153 may engage with an outer surface of the blade carrier 130 (a wall of the blade carrier that defines at least part of the opening 133) to prevent the button 151 from falling out of the opening 133 (i.e., laterally away from the slider 154). To prevent vertical upward movement, the tabs 153 may selectively engage with the first ledges or barriers 134. The interaction of the slider 154 to the spring 190 to the back side of the button 151 prevents the button 151 from moving in a lateral direction towards the first plate 170. In this regard, the first plate 170 holds the slider 154, which in turn provides the force to prevent the button 151 from being pushed without limit towards the first plate 170. However and as described herein, the spring 190 permits movement of the button 151 towards the slider 154, which is described in more detail below.

Figure 5:
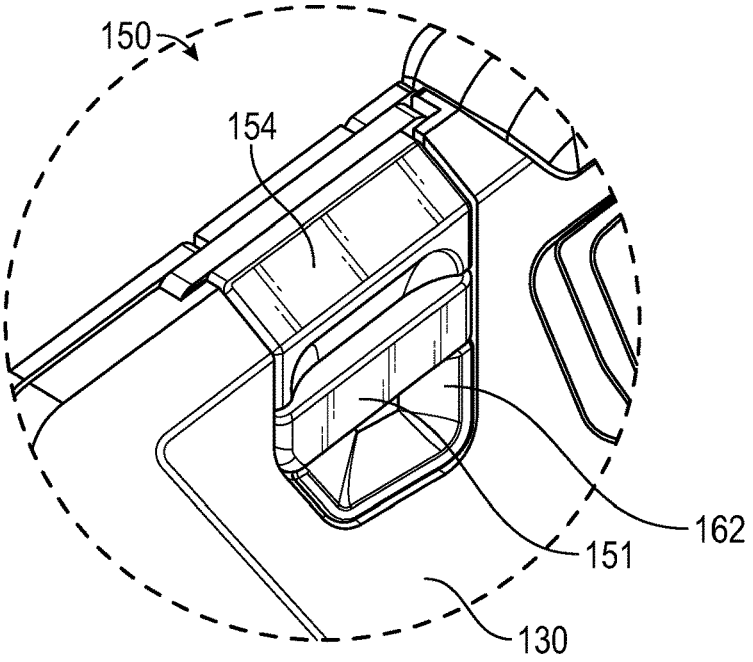
FIGS. 5-6 are perspective (FIG. 5) and side (FIG. 6) views of the blade retention mechanism of FIG. 1 in the locked position, according to exemplary embodiments.
Figure 6:
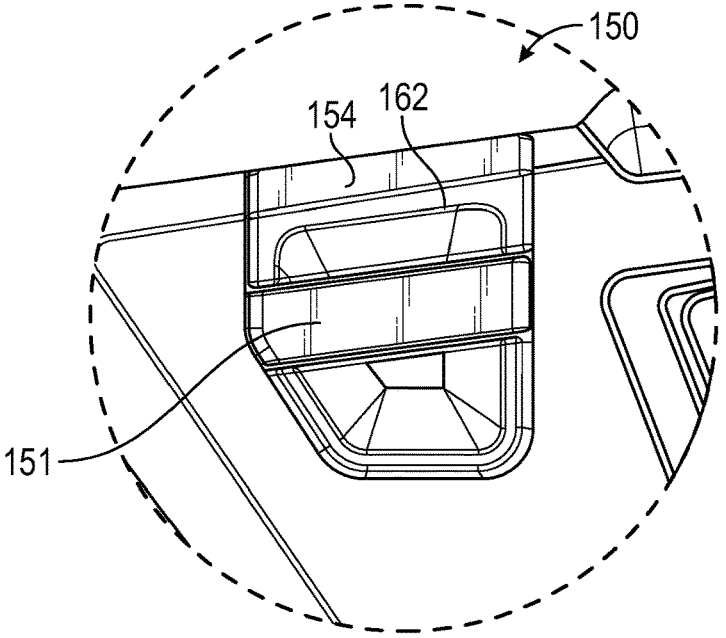
Figure 7:
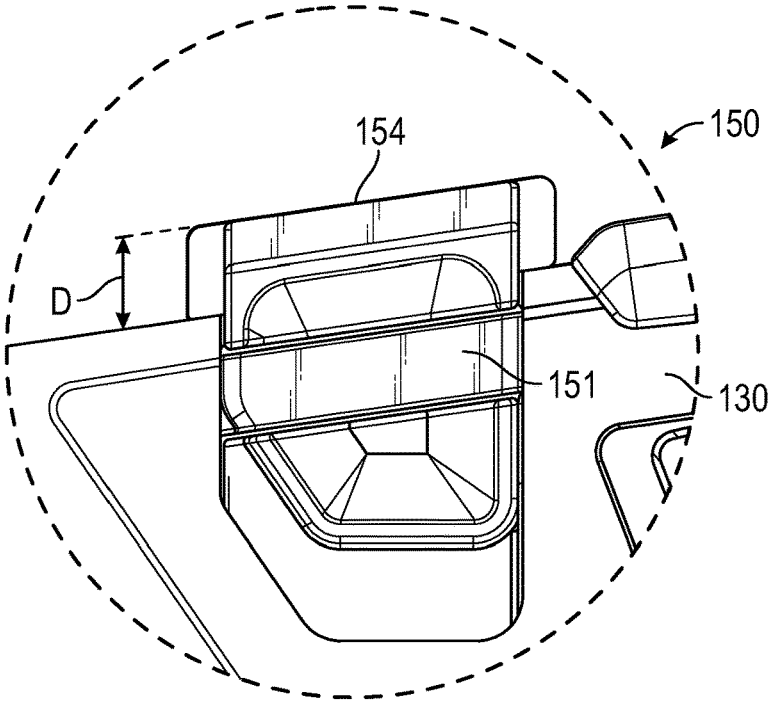
FIGS. 7-8 are perspective (FIG. 7) and side (FIG. 8) views of the blade retention mechanism of FIG. 1 in the unlocked position, according to exemplary embodiments.
Figure 8:
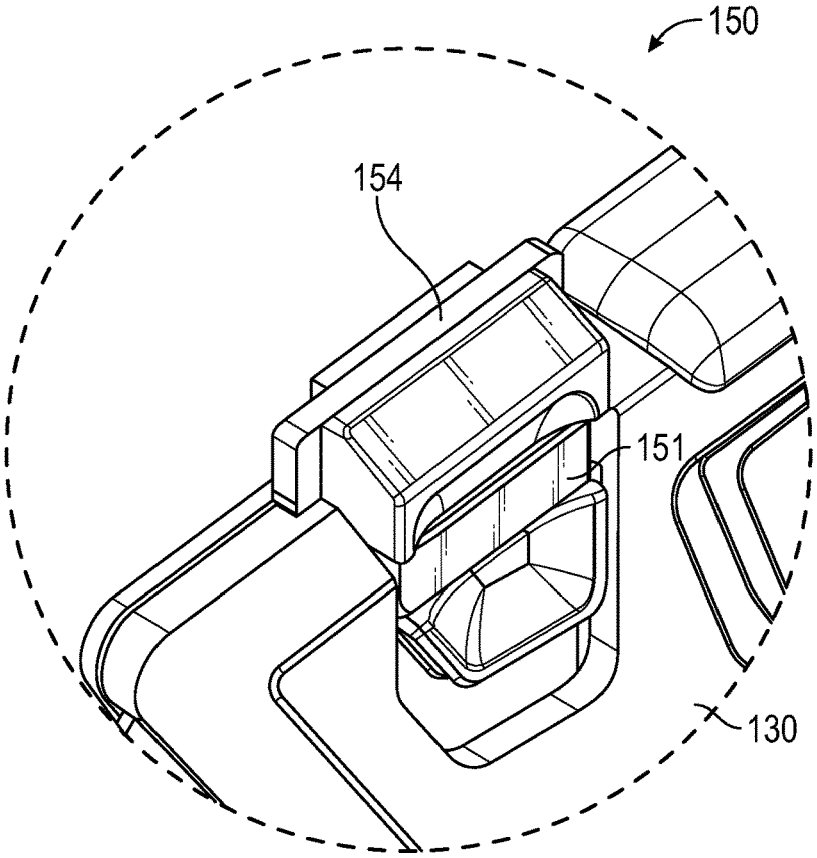
Figure 10A:
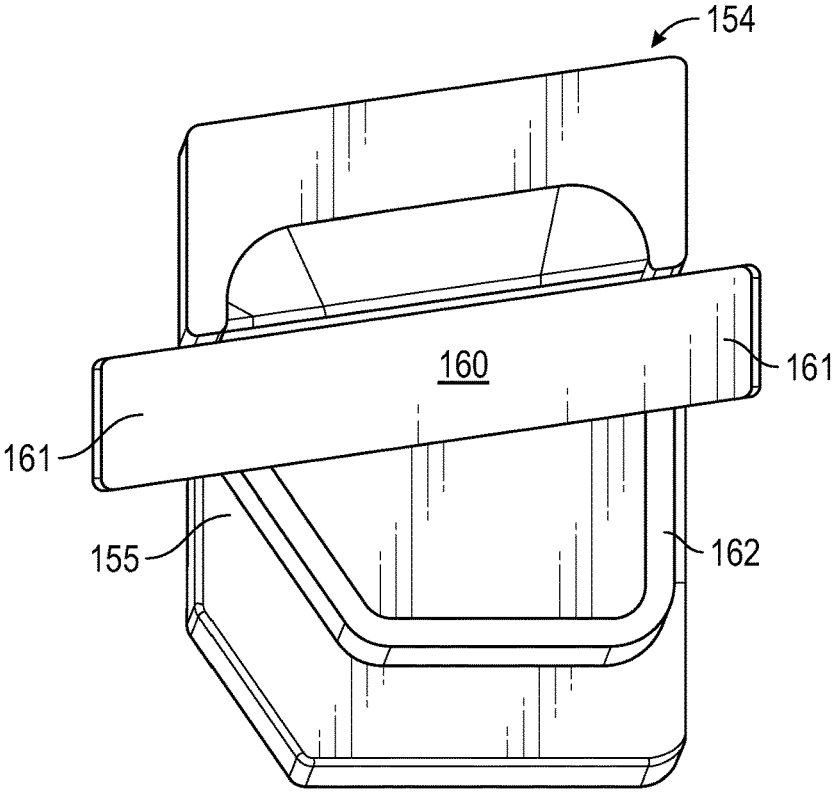
FIGS. 10A-10B are front (FIG. 10A) and side (FIG. 10B) views of the slider of the blade retention mechanism of FIGS. 1-9, according to exemplary embodiments.
Figure 10B:
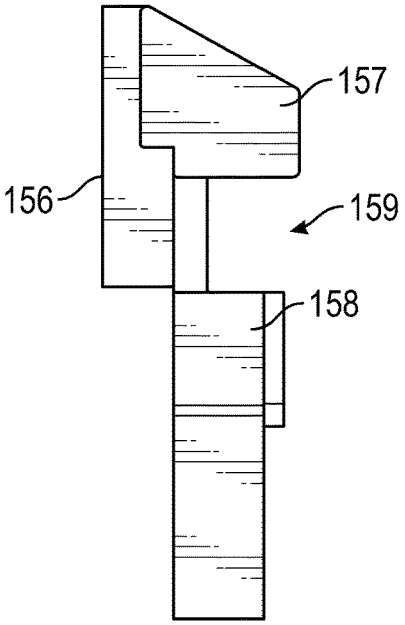

Referring now to FIGS. 10A and 10B in combination with FIG. 9, front (FIG. 10A) and side (FIG. 10B) views of the slider 154 are shown according to exemplary embodiments. As described herein, the slider 154 is movable between a first position (a locked position) and a second position (an unlocked position). In the locked position, a top portion of the slider 154 sits substantially flush with the blade carrier 130. This position is shown in FIGS. 5-6. In the unlocked position, the slider 154 extends vertically upward and away from the blade carrier 130 (i.e., not flush or substantially flush with a top portion of the blade carrier 130) (i.e., at least a part of the slider 154 is moved a greater distance away from blade carrier 130 than in the locked position). This position is shown in FIGS. 7-8. As described herein, positioning of the slider 154 in the unlocked position enables the utility knife blade 120 to be released and removed from the blade carrier 130 for, e.g., replacement. In contrast, positioning of the slider 154 in the locked position securely holds or retains the utility knife blade 120 in the blade carrier 130. As shown and generally speaking, the slider 154 (e.g., second actuator, lift lock, etc.) includes a body 155 having a pair of projections 156 (e.g., bosses, lugs, etc.) extending laterally outward and away from the body 155, a top part 157, a bottom part 158 positioned vertically below the top part 157, a cavity or recess 159 defined between the top and bottom parts 157 and 158, a surface 160 disposed in the cavity 159, a pair of tabs 161 interconnected with the surface 160 and extending laterally outward and away from the body 155, and a user engagement portion 162. The user engagement portion 162 (e.g., recess, finger receptacle, etc.) is generally concave shaped and configured to receive a user's finger to facilitate lifting or moving of the slider 154 vertically upwards to the unlocked position. In other configurations, the shape and size of the user engagement portion 162 can vary from that depicted in the Figures. In the example depicted, the slider 154 is a one-piece component made out of a metal-based material. However, in other embodiments, the slider 154 may be constructed from two or more components and made out of a variety of materials.

As shown, a pair of projections 156 extend laterally outward and away from the body 155. In this regard, the projections 156 extend away from the button 151 when the blade retention mechanism 150 is coupled to the blade carrier 130. The projections 156 are sized and shaped to correspond with conventional recesses in conventional utility knife blades. In this regard and as shown, the projections 156 have an oval type shape. With reference to FIG. 11, the utility knife blade 120 includes a pair of recesses 121. As described herein, when the slider 154 is in the locked position (i.e., vertically downward position), the recesses 121 at least partly receive the projections 156. The reception of the projections 156 then prevents the blade 120 from being pulled out of or sliding out of the blade carrier 130. In other words, the reception of the projections 156 by the recesses 121 (in combination with the locked position of the button 151) acts to securely or substantially securely retain the blade 120. When the slider 154 is in the first position (unlocked position), the projections 156 are raised vertically above the recesses 121, such that the blade 120 can slide or move in and out of the blade carrier 130 to enable replacement of the blade 120.

As mentioned above, the top portion 157 and bottom portion 158 of the body 155 define a cavity 159 (e.g., recess). A back surface 160 of the recess 159 extends laterally outward and away from the body 155 to form/provide a pair of oppositely positioned tabs 161. In other words, the tabs 161 and cavity 159 are positioned as an intermediary between the top portion 157 and the bottom portion 158. As shown, the cavity 159 is generally rectangular shaped, and sized to selectively receive the spring 190 and the button 151. In other words, the cavity 159 has a matching or a substantially matching shape to that of the spring 190 and the button 151. As described herein, the cavity 159 receives the spring 190 and at least part of the button 151. As such and once assembled, the top and bottom portions 157 and 158 constrain or restrict a vertical upward and downward movement of the spring 190 and button 151.

The spring or biasing member 190 is structured to bias the button 151 away from the slider 154. More particularly, the spring 190 is structured to bias the button 151 in a lateral direction away from the slider 154 to position the tabs 153 of the button 151 in the first opening 133, such that the tabs 153 may engage with the ledges 134 (when in the locked position to, in turn, restrict vertical movement of the slider 154 and button 151). In the example shown, the spring 190 is structured as a leaf spring. In other embodiments, a different type of spring may be utilized (e.g., a coil spring). All such variations are intended to fall within the scope of the present disclosure.

Based on the foregoing, a description of the assembly of the blade retention mechanism 150 may be described as follows. The bottom portion of the body 155 (proximate the bottom portion 158) is received in the second cavity 132. The top portion of the body 155 (proximate the top portion 157) is at least partly received in the first and second openings 133 and 135. The first plate 170 then holds the slider 154 in place and prevents or substantially prevents the slider 154 from moving in a lateral direction away from the button 151. In contrast, the tabs 161 in combination with the spring 190 and button 151 as well as at least a part of the bottom portion of the body 155 may engage with the blade carrier 130 to prevent or substantially prevent the slider 154 from moving in a lateral direction towards the button 151 (i.e., a lateral direction away from the first plate 170). Thus, the blade carrier 130 and first plate 170 hold the slider 154 in a use position (i.e., able to move between the locked and unlocked position).

With respect to the locked position of the slider 154, the spring 190 biases or otherwise forces the button 151 away from the slider 154. As a result, the tabs 153 of the button 151 are disposed in the first opening 133 and movement of the button 1511 laterally is constrained by the blade carrier 130 and vertically by the ledges 134 as well as a portion of the blade carrier 130 that defines the second cavity 132 (this portion limits vertically downward movement of the button 151). At this point, without depressing the button 151, the slider 154 cannot move to the unlocked position. This is due to the bottom portion 158 of the slider 154 engaging with the button 151, and the button 151 being unable to move upwards due to the engagement of the button 151 with the ledges 134.

In operation then and assuming the blade retention mechanism is in the locked position (i.e., FIGS. 5-6) and if a user desires to move the slider 154 to the unlocked position, the user pushes the button 151 towards the slider 154. This lateral movement is in a direction perpendicular or substantially perpendicular to the subsequent vertical movement of the slider 154. Additionally, this push flattens the spring 190, which thereby enables the button 151 (particularly the tabs 153) to move out of the first opening 133, such that the tabs do not/are unable to engage with the ledges 134. Then, the user may in combination with the push of the button 151 move or urge the button 151 vertically upwards by engaging their finger with the user engagement portion 162 of the slider 154. Due to the disengagement between the ledges 134 and the button 151, the slider 154 is then able to move vertically upward in combination with the spring 190 and button 151. In this regard and at this point, the spring 190 and button 151 are both substantially completely received in the cavity 159 of the slider 154. The slider 154 in combination with the spring 190 and button 151 are then able to be moved vertically upwards to the unlocked position. The vertical movement is then stopped when at least one of the tabs 153 of the button 151 and the tabs 161 of the slider 154 engage with the ledges 136 in the second opening 135. At this point and in the unlocked position, the projections 156 are disengaged from the utility knife blade 120 and the utility knife blade 120 can be removed and replaced, if desired, from the utility knife 100. To then lock the blade 120 in the blade carrier, the user inserts the blade 120 into the blade carrier 130 (i.e., in the gap between the first and second plates 170 and 180), and pushes the slider 154 vertically downwards towards the blade carrier 130. During the downward movement and when the button 151 becomes proximate to the first opening 133, the spring 190 pushes the button 151 laterally outward into the first opening 133. At which point, the button 151 is constrained from vertically moving upwards due to the engagement or potential engagement of the tabs 153 and the ledges 134. As such and as described above, the slider 154 is then unable to move upwards. Further, the projections 156 of the slider 154 are received in the recesses 121 of the blade 120. As a result, the projections 156 of the slider 154 cannot be disengaged from the recesses 121 of the blade 120, which locks the blade 120 to the blade carrier 130 and knife 100 generally.

Based on the foregoing and referring now to FIG. 11, a graphical depiction of a method of unlocking a utility knife blade 120 in the utility knife 100 is shown according to an exemplary embodiment. At step 1101, the push button 151 is depressed (i.e., moved or slid in a direction towards the slider 154). Depression of the button 151 flattens the spring 190 to enable the tabs 153 to disengage from the ledges 134. At step 1102, the slider or lift lock 154 is moved; particularly, the slider 154 is moved vertically upwards and away from the blade carrier 130. This is due to the disengagement of the button 151 from the first part of the blade carrier 130 (i.e., the ledges 134). Vertical movement of the button 151, spring 190, and slider 154 is then stopped by the engagement of at least one of the button 151 and slider 190 with a second, vertically higher, part of the blade carrier 130 (i.e., the ledge 136). At or near the vertical maximum movement of the slider 154, the projections 156 of the slider 154 are moved above and out of the way of the blade 120, such that the projections 156 do not or substantially do not interfere or obstruct movement of the blade 120. At step 1103, accordingly, the blade 120 is inserted into the blade carrier 130 (i.e., between the first and second plates 170 and 180). At step 1104, the slide lock 154 is pushed vertically downwards. Assuming the blade 120 is fully inserted in the correct position in the blade carrier 130, the projections 156 will then engage with the recesses 121 of the blade 120. The spring 190 will bias the button 151 outwards and create an audible click or snap. Due to the engagement of the projections 156 with the recesses 121 of the blade 120, the blade 120 is locked in the blade carrier (i.e., unable to be removed). To remove the blade 120 (e.g., for replacement), a user simply depresses the button 151 and moves the slider 154 upwards to disengage the projections 156 from the recesses 121 of the blade 120. The blade 120 may then be removed.

Beneficially, several features and advantages of the blade retention mechanism 150 of the present disclosure are provided. First, the use of a two-stage unlock mechanism (i.e., the pushing of the button 151 and the raising of the slider 154) prevents or substantially prevents inadvertent unlocks of the blade 120. Second, the relative ease of completing the two stages still provides users with an ability to quickly replace or remove the blade. Third, the audible click that is generated when the button 151 moves to the first or locked position provides users with an indication that the blade is securely retained. Fourth, when in the unlocked position, the slider 154 protrudes above the blade carrier to thereby provide users with a visual indication that the slider 154 is in the unlocked position. This is beneficial because users can then readily see whether the blade is locked in or not. With reference to FIG. 7, this is shown by the distance, D, that separates at least a portion of the slider 154 from the blade carrier 130. As shown, this distance, D, is relatively significant to provide the visual indication. Fifth, the slider 154 is unable to be moved to the lock position unless the blade 120 is inserted into the correct position where the recesses 121 and the projections 156 align. As such, users need not guess whether the blade 120 is correctly inserted or not. Thus, the blade retention mechanism of the present disclosure offers several advantages and benefits over conventional utility knife blade retention mechanisms. It should be understood that the aforementioned list is not meant to be exhaustive as the present disclosure contemplates other features and benefits that may be applicable with the blade retention mechanism 150.

As mentioned herein above with respect to certain components, it should further be understood that one or more additional/other components of the knife 100 may be constructed as a unitary body (e.g., a one-piece component) or as an assembly of components. Further, these components may be constructed from any suitable material including, but not limited to, a plastic material, rubber, a metal or metal alloy material, and/or any combination therewith. For example, the use of engineered plastics may provide a preferred combination of light weight and strength. According to other embodiments, a number of alternate materials can be used to produce the knife and blade retention assembly: cast or machined aluminum or brass could be utilized in the construction, a variety of steels, various composites, and/or any combination thereof. Thus, those of ordinary skill in the art will appreciate the high configurability of the components.

As utilized herein, the terms "approximately," "about," "substantially," and similar terms are intended to have a broad meaning in harmony with the common and accepted usage by those of ordinary skill in the art to which the subject matter of this disclosure pertains. Thus, these terms may be defined and/or interpreted in a quantifiable manner (e.g., an exact number, a range of numbers, various tolerances, etc.) and/or in a qualitative manner (e.g., analyzing the characteristics or properties of the disclosure in operation for compliance with a standard, goal, threshold, principle, or the like). Thus, those of ordinary skill in the art will readily recognize and appreciate the broad interpretability of these and similar terms, with all such interpretations intending to fall within the spirit and scope of the present disclosure.

It is important to note that the construction and arrangement of the elements of the utility knife with a blade retention mechanism is illustrative only. Although only a few embodiments have been described in detail in this disclosure, those skilled in the art who review this disclosure will readily appreciate that many modifications are possible without materially departing from the novel teachings and advantages of the subject matter recited.

Further, all such modifications are intended to be included within the scope of the present disclosure. Other substitutions, modifications, changes and omissions may be made in the design, operating conditions and arrangement of the preferred and other exemplary embodiments without departing from the spirit of the present disclosure possible (e.g., variations in sizes, dimensions, structures, shapes and proportions of the various elements, values of parameters, mounting arrangements, use of materials, colors, orientations, etc.). Thus, one of ordinary skill in the art will appreciate that many modifications, alterations, or changes may be imparted into the tools disclosed herein without departing from the spirit and scope of the present disclosure.

For the purpose of this disclosure, the term "coupled" or other similar terms, such as "attached," means the joining of two members directly or indirectly to one another. Such joining may be achieved directly with the two members or the two members and any additional intermediate members being attached to one another and the two members. For example and for the purposes of this disclosure, component A may be referred to as being "coupled" to component B even if component C is an intermediary, such that component A is not directly connected to component B. On the other hand and for the purposes of this disclosure, component A may be considered "coupled" to component B if component A is directly connected to component B (e.g., no intermediary). Such joining may be stationary or moveable in nature. Such joining may be permanent in nature or may be removable or releasable in nature.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present disclosure as expressed in the appended claims.

What is claimed is:

1. A utility knife, comprising:

a handle;

a blade carrier coupled to the handle, the blade carrier is releasably coupled to a utility knife blade by a blade retention mechanism;

the blade retention mechanism including:

a button; and a slider with a body having a pair of projections extending outward and away from the body, the slider is received in a first opening of the blade carrier and movably coupled to the button, the slider is perpendicularly movable relative to a longitudinal length of the utility knife between a locked position, where the pair of projections engage with a pair of recesses in the blade carrier, and an unlocked position, where the slider protrudes outward and away from the blade carrier, wherein in the locked position the slider engages with the utility knife blade to securably retain the utility knife blade, wherein in the unlocked position the slider is disengaged from the utility knife blade to permit removal of the utility knife blade, and wherein during a movement of the slider from the locked position to the unlocked position, the slider moves away from the blade carrier; and wherein an actuation of the button in a direction perpendicular or substantially perpendicular to a movement direction associated with the slider between the locked and unlocked positions enables the slider to move, together with the button, from the locked position to the unlocked position.

2. The utility knife claim 1, wherein the slider includes a top portion and a bottom portion, the top portion and bottom portion defining a cavity, said projections extending outward and away from the body are arranged in the top portion;

wherein the button is at least partly received in the cavity during a movement of the slider from the locked to unlocked positions.

3. The utility knife of claim 1, further comprising:

a first plate coupled to the blade carrier, the slider is sandwiched between the first plate and the button; and a second plate coupled to the blade carrier;

wherein the first plate is positioned proximate the slider, and wherein a gap is defined between the first and second plates that is configured to selectively receive the utility knife blade.

4. The utility knife of claim 3, wherein the first plate defines a pair of recesses, wherein the second plate defines a pair of recesses, wherein the slider includes a pair of projections, wherein the pair of projections are at least partly received by each of the pair of recesses defined by each of the first and second plates.

* * * * *